US005615300A

United States Patent [19]

Hara et al.

[11] Patent Number: 5,615,300

[45] Date of Patent: Mar. 25, 1997

[54] TEXT-TO-SPEECH SYNTHESIS WITH CONTROLLABLE PROCESSING TIME AND SPEECH QUALITY

[75] Inventors: Yoshiyuki Hara, Tokyo; Tsuneo Nitta, Yokohama, both of Japan

[73] Assignee: Toshiba Corporation, Kanagawa-ken, Japan

[21] Appl. No.: 67,079

[22] Filed: May 26, 1993

[30] Foreign Application Priority Data

May 28, 1992 [JP] Japan ..... 4-137177

[51] Int. Cl.[6] ..... G10L 9/00

[52] U.S. Cl. ..... 395/2.69; 395/2.76; 395/2.77

[58] Field of Search ..... 395/2.67, 2.69, 395/2.76, 2.77, 2, 2.4, 2.44, 2.73–2.75; 381/40, 51, 52

[56] References Cited

U.S. PATENT DOCUMENTS 4,296,279 10/1981 Stork ..... 395/2.77
4,581,757 4/1986 Cox ..... 395/2.67
4,618,936 10/1986 Shiono ..... 395/2.76
4,709,340 11/1987 Capizzi et al. ..... 395/2.77
4,817,161 3/1989 Kaneko ..... 395/2.76
4,896,359 1/1990 Yamamoto et al. ..... 381/52

FOREIGN PATENT DOCUMENTS 63-69792 9/1989 Japan .

*Primary Examiner*—Allen R. MacDonald
*Assistant Examiner*—Michael A. Sartori
*Attorney, Agent, or Firm*—Finnegan, Henderson, Farabow, Garrett & Dunner, L.L.P.

[57] ABSTRACT

Synthesized speech is generated by a software-implemented system with a programmed central processing unit. Phonetic parameters are generated from a series of phonetic symbols of an input text to be converted into synthesized speech, and prosodic parameters are also generated from prosodic information of the input text. The activity ratio of the central processing unit is determined, and the order of phonetic parameters or the arrangement of a synthesis unit or filter for speech synthesis is determined depending on the determined activity ratio of the central processing unit. Synthesized speech sounds are generated and filtered based on the phonetic and prosodic parameters according to the determined order of phonetic parameters or the determined arrangement of the filter.

15 Claims, 11 Drawing Sheets

FIG.6A

| ORDER N OF PHONETIC PARAMETERS | PROCESSING RATE P [MIPS] |
|---|---|
| Q1=20 | P1=29 |
| Q2=10 | P2=20 |
| Q3=6 | P3=10 |

FIG.6B

| | |
|---|---|
| MODE SELECTING INFORMATION | 1 ----- TO SELECT INFORMATION FROM INPUT UNIT 11<br>2 ----- TO SELECT INFORMATION FROM RATE CONTROLLER 20 |
| TIMING INFORMATION | 1 ----- EVERY FRAME<br>2 ----- EVERY ACCENT PHRASE<br>3 ----- EVERY BREATHING PHRASE (PAUSE)<br>4 ----- EVERY SENTENCE<br>5 ----- EVERY PARAGRAPH<br>6 ----- ONLY ONCE AT BEGINNING |

FIG.7A
KONDONO KAIGIWA, 5 GATSU 10 KANI KIMARIMASHITA.
TSUGOUNO WARUIKATAWA, YAMADAMADE OSHIRASEKUDASAI.
(THE NEXT MEETING WILL BE HELD ON MAY 10. ANYBODY WHO CANNOT MAKE IT SHOULD NOTIFY YAMADA.)
FIG.7B
KO^NDONO/KA^IGIWA.../GO^GATSU/TOUKANI./KIMARIMA^SHITA...//
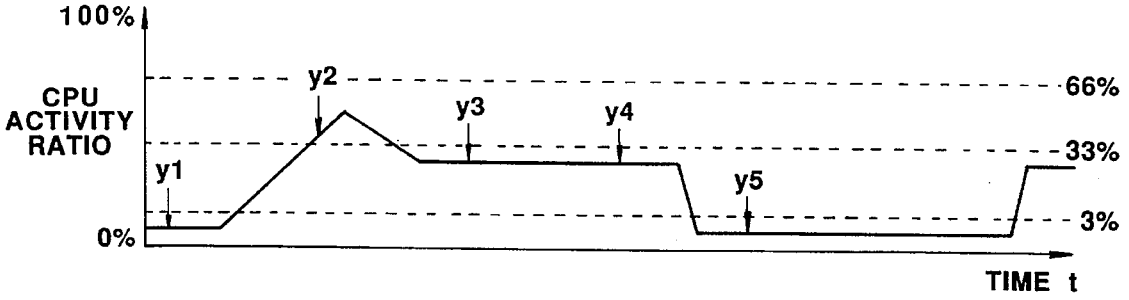
FIG.7C
TSUGOUNO/WARU^IKATAWA../YAMADAMA^DE./OSHIRASEKUDASA^I...//
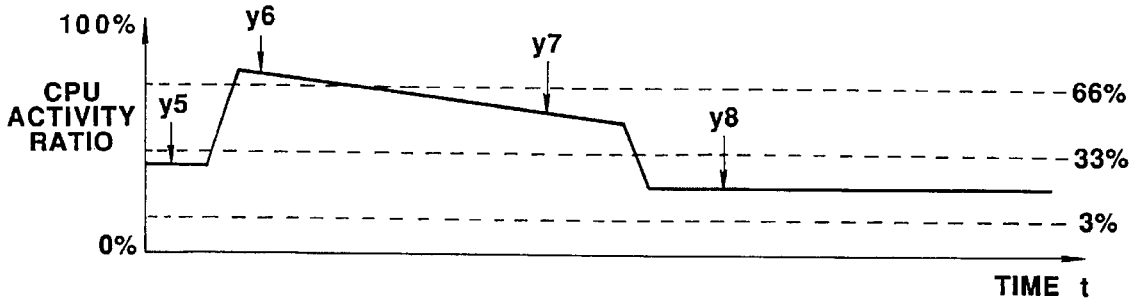

FIG.7D

KO^NDONO/KA^IGIWA.../GO^GATSU/TOUKANI/KIMARIMA^SHITA...//
ORDER N 20 6 10 10 20

FIG.7E

TSUGOUNO/WARU^IKATAWA../YAMADAMA^DE/OSHIRASEKUDASA^I...//
ORDER N 10 6 6 10

FIG.7F

KO^NDONO;KA^IGIWA../GO^GATSU/TOUKANI/KIMARIMA^SHITA..//
ORDER N 20 10 20
20

FIG.7G

TSUGOUNO/WARU^IKATAWA../YAMADAMA^DE/OSHIRASEKUDASA^I..//
ORDER N 10 6 10
10

| FILTER ARRANGEMENT | PROCESSING RATE P [MIPS] |
|---|---|
| Q1=#C | P1=29 |
| Q2=#B | P2=20 |
| Q3=#A | P3=10 |

TEXT-TO-SPEECH SYNTHESIS WITH CONTROLLABLE PROCESSING TIME AND SPEECH QUALITY

BACKGROUND OF THE INVENTION

1. Field of the Invention:

The present invention relates to a method of and an apparatus for generating synthesized speech from either a sequence of character codes or a series of phonetic symbols and prosodic information associated therewith.

2. Description of the Prior Art:

Recently, there have been developed various speech synthesizers for analyzing Japanese sentences composed of a mixture of Kanji (Chinese) characters and Kana (Japanese syllabary) characters and generating synthesized speech from phonetic and prosodic information represented by the analyzed sentences according to the synthesis-by-rule process. Such speech synthesis systems are finding wide use in telephone information services in the banking business, newspaper revising systems, document readers, and other apparatus employing synthesized speech.

Basically, the speech synthesizer based on the synthesis-by-rule process operates as follows: The speech synthesizer has a speech segment file which stores phonetic information that has been obtained by the LSP (line spectrum pair) analysis or the cepstrum analysis from each unit of human speech which may be of a syllable structure CV (consonant-vowel), a syllable structure CVC (consonant-vowel-consonant), a syllable structure VCV (vowel-consonant-vowel), or a syllable structure VC (vowel-consonant). When a text is inputted to the speech synthesizer, the speech synthesizer analyzes the text, produces phonetic and prosodic parameters for the text by referring to the speech segment file, and generates and filters sound sources based on the phonetic and prosodic parameters for generating synthesized speech of the text.

It has heretofore been customary to construct the speech synthesizer of dedicated hardware components that are required for real-time data processing. There are primarily two system designs available for the dedicated-hardware speech synthesizer. According to one system, a host computer such as personal computer converts a sentence of Kanji and Kana characters into phonetic and prosodic information, and a dedicated hardware device generates phonetic and prosodic parameters based on the converted phonetic and prosodic information, generates and filters sound sources, and converts the filtered sound sources into an analog speech signal for generating synthesized speech. According to the other system, all the above processing steps are executed by a dedicated hardware device. Usually, the dedicated hardware device of each of the above systems comprises an LSI circuit called a DSP (digital signal processor) which is capable of high-speed logic operations including ANDing and ORing, and a general-purpose MPU (microprocessor unit).

Recent years have seen another system approach to software-implementation of the above processing on a real-time basis. The software-implemented system has been made possible by a personal computer or an engineering work station having a high processing capability combined with a D/A converter, an analog output device, and a loudspeaker.

The software-implemented system is free of problems with respect to speech synthesis while it is processing a relatively few tasks. However, when many tasks require to be processed simultaneously by the system, the system may not be able to generate real-time synthesized speech. If the system fails to generate real-time synthesized speech, then unvoiced intervals are inserted in synthesized words, making it difficult for the user to hear the synthesized words clearly. Specifically, a certain constant period of time is needed for the CPU (central processing unit) of the system to carry out the process of speech synthesis. Therefore, insofar as the CPU of the system operates to process a relatively small number of tasks, it can produce synthesized speech on a real-time basis. However, when the CPU of the system is required to process an increased number of tasks, the CPU requires a longer execution time to process those tasks, possibly failing to generate real-time synthesized speech.

The present speech synthesizer that operates according to the synthesis-by-rule process can produce synthesized speech in different patterns that reflect such differences as sex, age, pronunciation rate, pitch, and stress. The user of the speech synthesizer can select any one of the different speech patterns according to his preference. However, the user cannot change the quality of the synthesized speech.

Most speech synthesizers that are available todaty generate crisp synthesized speech sounds that can be heard clearly. If the user of the speech synthesizer hears such crisp synthesized speech sounds for the first time, then the user will find them acceptable as they are sharp and clear. However, if the user who has become accustomed to synthesized speech hears crisp synthesized speech sounds for a continued period of time, then the user finds them physically and mentally fatiguing. Since the quality of synthesized speech, i.e., the quality of being crisp, cannot be changed, the conventional speech synthesizer does not lend itself to continuous usage for a long period of time.

SUMMARY OF THE INVENTION

It is therefore an object of the present invention to provide a method of and an apparatus for generating synthesized speech while allowing a period of time required for speech synthesis and the quality of synthesized speech to be varied by varying the order of filtering for speech synthesis.

Another object of the present invention is to provide a method of and an apparatus for generating synthesized speech while allowing a period of time required for speech synthesis and the quality of synthesized speech to be varied by varying the arrangement of a synthesis unit used for filtering for speech synthesis.

Still another object of the present invention is to provide a method of and an apparatus for generating high-quality synthesized speech on a real-time basis by varying the order of filtering for speech synthesis or the arrangement of a synthesis unit depending on the activity ratio of a central processing unit that is programmed for speech synthesis.

According to the present invention, there is provided a method of synthesizing speech, comprising the steps of generating phonetic parameters from a series of phonetic symbols of an input text to be converted into synthesized speech, generating prosodic parameters from prosodic information of the input text, supplying information representative of the order of phonetic parameters, and generating and filtering synthesized speech sounds based on the phonetic and prosodic parameters according to the supplied information.

According to the present invention, there is also provided a method of synthesizing speech, comprising the steps of generating phonetic parameters from a series of phonetic symbols of an input text to be converted into synthesized speech, generating prosodic parameters from prosodic information of the input text, supplying information representative of the quality of synthesized speech sounds to be generated, and generating and filtering synthesized speech sounds based on the phonetic and prosodic parameters according to the supplied information.

According to the present invention, there is also provided a method of synthesizing speech, comprising the steps of generating phonetic parameters from a series of phonetic symbols of an input text to be converted into synthesized speech, generating prosodic parameters from prosodic information of the input text, supplying information representative of the arrangement of a synthesis unit to be used, and generating and filtering synthesized speech sounds based on the phonetic and prosodic parameters with a synthesis unit which is arranged according to the supplied information.

According to the present invention, there is also provided a method of synthesizing speech with a system having a programmed central processing unit, comprising the steps of generating phonetic parameters from a series of phonetic symbols of an input text to be converted into synthesized speech, generating prosodic parameters from prosodic information of the input text, determining the activity ratio of the central processing unit, determining the order of phonetic parameters depending on the determined activity ratio of the central processing unit, and generating and filtering synthesized speech sounds based on the phonetic and prosodic parameters according to the determined order of phonetic parameters.

According to the present invention, there is also provided a method of synthesizing speech with a system having a programmed central processing unit, comprising the steps of generating phonetic parameters from a series of phonetic symbols of an input text to be converted into synthesized speech, generating prosodic parameters from prosodic information of the input text, determining the activity ratio of the central processing unit, determining the arrangement of a synthesis unit to be used depending on the activity ratio of the central processing unit, and generating and filtering synthesized speech sounds based on the phonetic and prosodic parameters according to the determined arrangement of a synthesis unit to be used.

According to the present invention, there is also provided a method of synthesizing speech with a system having a programmed central processing unit, comprising the steps of generating phonetic parameters from a series of phonetic symbols of an input text to be converted into synthesized speech, generating prosodic parameters from prosodic information of the input text, determining the activity ratio of the central processing unit, supplying information representative of the quality of synthesized speech sounds to be generated depending on the activity ratio of the central processing unit, and generating and filtering synthesized speech sounds based on the phonetic and prosodic parameters according to the supplied information.

According to the present invention, there is also provided an apparatus for synthesizing speech, comprising means for generating phonetic parameters from a series of phonetic symbols of an input text to be converted into synthesized speech, means for generating prosodic parameters from prosodic information of the input text, means for supplying information representative of the order of phonetic parameters, and means generating and filtering synthesized speech sounds based on the phonetic and prosodic parameters according to the supplied information.

According to the present invention, there is also provided an apparatus for synthesizing speech, comprising means for generating phonetic parameters from a series of phonetic symbols of an input text to be converted into synthesized speech, means for generating prosodic parameters from prosodic information of the input text, means for supplying information representative of the quality of synthesized speech sounds to be generated, and means for generating and filtering synthesized speech sounds based on the phonetic and prosodic parameters according to the supplied information.

According to the present invention, there is also provided an apparatus for synthesizing speech, comprising means for generating phonetic parameters from a series of phonetic symbols of an input text to be converted into synthesized speech, means for generating prosodic parameters from prosodic information of the input text, a plurality of synthesis units for effecting filtering on synthesized speech sounds for respective different periods of time, input means for supplying information representative of one of said synthesis units, selector means for selecting one of said synthesis units according to the information supplied by said input means, and speech synthesizer means for generating and filtering synthesized speech sounds based on the phonetic and prosodic parameters with said one of the synthesis units which is selected by said selector means.

According to the present invention, there is also provided an apparatus for synthesizing speech with a system having a programmed central processing unit, comprising means for generating phonetic parameters from a series of phonetic symbols of an input text to be converted into synthesized speech, means for generating prosodic parameters from prosodic information of the input text, extractor means for determining the activity ratio of the central processing unit, control means for determining the order of phonetic parameters depending on the determined activity ratio of the central processing unit, and speech synthesizer means for generating and filtering synthesized speech sounds based on the phonetic and prosodic parameters according to the determined order of phonetic parameters.

According to the present invention, there is also provided an apparatus for synthesizing speech with a system having a programmed central processing unit, comprising means for generating phonetic parameters from a series of phonetic symbols of an input text to be converted into synthesized speech, means for generating prosodic parameters from prosodic information of the input text, a plurality of synthesis units for effecting filtering on synthesized speech sounds for respective different periods of time, extractor means for determining the activity ratio of the central processing unit, control means for determining the arrangement of a synthesis unit according to the determined activity ratio of the central processing unit, selector means for selecting one of said synthesis units which has the determined arrangement, and speech synthesizer means for generating and filtering synthesized speech sounds based on the phonetic and prosodic parameters with said one of the synthesis units which is selected by said selector means.

According to the present invention, there is also provided an apparatus for synthesizing speech with a system having a programmed central processing unit, comprising means for generating phonetic parameters from a series of phonetic symbols of an input text to be converted into synthesized speech, means for generating prosodic parameters from prosodic information of the input text, a plurality of synthesis units for effecting filtering on synthesized speech sounds for respective different periods of time, extractor means for determining the activity ratio of the central processing unit, input means for supplying information representative of the quality of synthesized speech sounds to be generated according to the determined activity ratio of the central processing unit, and speech synthesizer means for generating and filtering synthesized speech sounds based on the phonetic and prosodic parameters according to the supplied information.

According to the present invention, there is also provided an apparatus for synthesizing speech with a system having a programmed central processing unit, comprising means for generating phonetic parameters from a series of phonetic symbols of an input text to be converted into synthesized speech, means for generating prosodic parameters from prosodic information of the input text, input means for supplying information representative of the order of phonetic parameters in a first mode, extractor means for determining the activity ratio of the central processing unit in a second mode, mode selector means for selecting one of said first and second modes, control means for determining information representative of the order of phonetic parameters depending on the determined activity ratio of the central processing unit, and speech synthesizer means for generating and filtering synthesized speech sounds based on the phonetic and prosodic parameters according to the information supplied by said input means in said first mode and according to the information determined by said control means in said second mode.

According to the present invention, there is also provided an apparatus for synthesizing speech with a system having a programmed central processing unit, comprising means for generating phonetic parameters from a series of phonetic symbols of an input text to be converted into synthesized speech, means for generating prosodic parameters from prosodic information of the input text, input means for supplying information representative of the quality of synthesized speech sounds to be generated in a first mode, extractor means for determining the activity ratio of the central processing unit in a second mode, mode selector means for selecting one of said first and second modes, control means for determining information representative of the quality of synthesized speech sounds to be generated depending on the determined activity ratio of the central processing unit, and speech synthesizer means for generating and filtering synthesized speech sounds based on the phonetic and prosodic parameters according to the information supplied by said input means in said first mode and according to the information determined by said control means in said second mode.

According to the present invention, there is also provided an apparatus for synthesizing speech with a system having a programmed central processing unit, comprising means for generating phonetic parameters from a series of phonetic symbols of an input text to be converted into synthesized speech, means for generating prosodic parameters from prosodic information of the input text, a plurality of synthesis units for effecting filtering on synthesized speech sounds for respective different periods of time, input means for supplying information representative of one of said synthesis units in a first mode, extractor means for determining the activity ratio of the central processing unit in a second mode, mode selector means for selecting one of said first and second modes, control means for determining information representative of one of said synthesis units depending on the determined activity ratio of the central processing unit, selector means for selecting one of the synthesis units which is represented by the information supplied by said input means in said first mode and one of the synthesis units which is represented by the information determined by said control means in said second mode, and speech synthesizer means for generating and filtering synthesized speech sounds based on the phonetic and prosodic parameters with said selected one of the synthesis units.

The above and other objects, features, and advantages of the present invention will become apparent from the following description when taken in conjunction with the accompanying drawings which illustrate preferred embodiments of the present invention by way of example.

BRIEF DESCRIPTION OF THE DRAWINGS

FIGS. 6A and 6B are diagrams showing examples of information stored in a rate information file of the speech synthesizing apparatus shown in FIG. 3;

FIGS. 7A through 7G are diagrams showing a specific example of speech synthesis as well as an input text during operation of the speech synthesizing apparatus shown in FIG. 3;

DETAILED DESCRIPTION OF THE PREFERRED EMBODIMENTS

In the description that follows, reference is made to a certain Japanese text which is given as an example in conversion from text to speech. For an easier understanding, the Japanese sentences are fully transliterated and their meaning is fully given in English. It should be understood that the example in Japanese is employed only for a better description of the present invention and that the principles of the present invention are not limited to the Japanese language, but also applicable to other languages including English.

Figure 1:
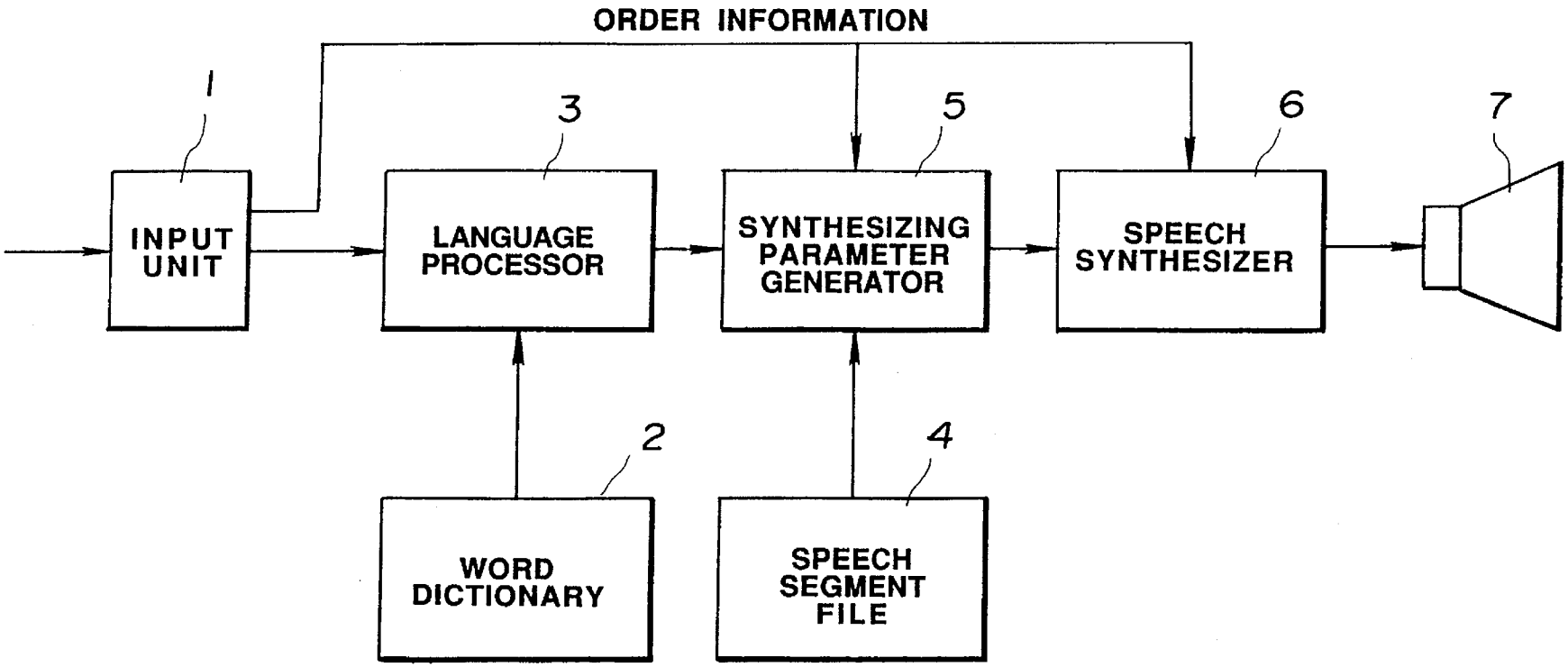
FIG. 1 is a block diagram of a speech synthesizing apparatus according to a first embodiment of the present invention.

1ST EMBODIMENT:

As shown in FIG. 1, a speech synthesizing apparatus according to a first embodiment of the present invention includes an input unit 1 for entering a series of character codes representing a mixture of Kanji and Kana characters to be converted into synthesized speech and control information for controlling the synthesized speech. The control information comprises order information to select the order N of synthetic parameters to be supplied to a filter in a speech synthesizer 6 (described later).

The speech synthesizing apparatus also has a word dictionary 2 storing registered accent types, pronunciations, and parts of speech of words and phrases to be converted into speech, and a linguistic processor 3 for analyzing a series of character codes entered from the input unit 1 with the information stored in the word dictionary 2 and generating a series of phonetic symbols and prosodic information associated therewith.

The speech synthesizing apparatus further includes a speech segment file 4 which stores a group of cepstral parameters that have been determined by analyzing units of input speech and information indicative of the orders of the cepstral parameters, and a synthetic parameter generator 5 for generating phonetic parameters, i.e., phonetic cepstral parameters, according to the series of phonetic symbols generated by the linguistic processor 3 and the order information from the input unit 1. The synthetic parameter generator 5 also serves to generate prosodic parameters according to the prosodic information generated by the linguistic processor 3.

The speech synthesizing apparatus also has a speech synthesizer 6 for generating a sound source based on the phonetic parameters generated by the synthetic parameter generator 5, the order information, and the prosodic parameters generated by the synthetic parameter generator 5, and filtering the generated sound source with an Nth-order filter to generate synthesized speech, and a loudspeaker 7 for outputting the generated synthesized speech. The speech synthesizer 6 includes a D/A converter (not shown) for converting the synthesized speech into an analog signal.

The speech synthesizing apparatus shown in FIG. 1 is realized by a personal computer (PC) or an engineering work station (EWS) which is capable of executing multiple tasks at the same time. The input unit 1, the linguistic processor 3, the synthetic parameter generator 5, and the speech synthesizer 6 are functional blocks whose functions are performed by a programmed sequence of a CPU of the personal computer or the engineering work station, i.e., by the execution of a speech synthesis task.

The speech synthesizing apparatus shown in FIG. 1 operates as follows:

A series of character codes representing a sentence of mixed Kanji and Kana characters to be converted into synthesized speech, and order information indicative of an order N are entered into the speech synthesizing apparatus through the input unit 1. The linguistic processor 3 compares the entered series of character codes with the word dictionary 2 to determine accent types, pronunciations, and parts of speech of words and phrases represented by the series of character codes, determines accent types and boundaries according to the parts of speech, and converts the sentence of mixed Kanji and Kana characters into a pronunciation format, for thereby generating a series of phonetic symbols and prosodic information.

The series of phonetic symbols and prosodic information generated by the linguistic processor 3 are then supplied to the synthetic parameter generator 5, which is also supplied with the order information from the input unit 1.

The synthetic parameter generator 5 extracts phonetic cepstral parameters corresponding to the series of phonetic symbols from the speech segment file 4 with respect to the order N represented by the order information from the input unit 1, for thereby generating phonetic parameters. At the same time, the synthetic parameter generator 5 generates prosodic parameters according to the prosodic information.

The synthetic parameter generator 5 supplies the phonetic parameters and the prosodic parameters to the speech synthesizer 6, which temporarily holds the supplied phonetic and prosodic parameters together with the order information supplied from the input unit 1. Then, based on the phonetic and prosodic parameters and the order information, the speech synthesizer 6 generates a sound source and effects digital filtering on the sound source to generate synthesized speech representing the entered series of character codes. The generated synthesized speech is converted by the D/A converter into an analog speech signal, which is applied to the loudspeaker 7. The loudspeaker 7 now produces synthesized speech sounds corresponding to the entered sentence of mixed Kanji and Kana characters.

Figure 2:
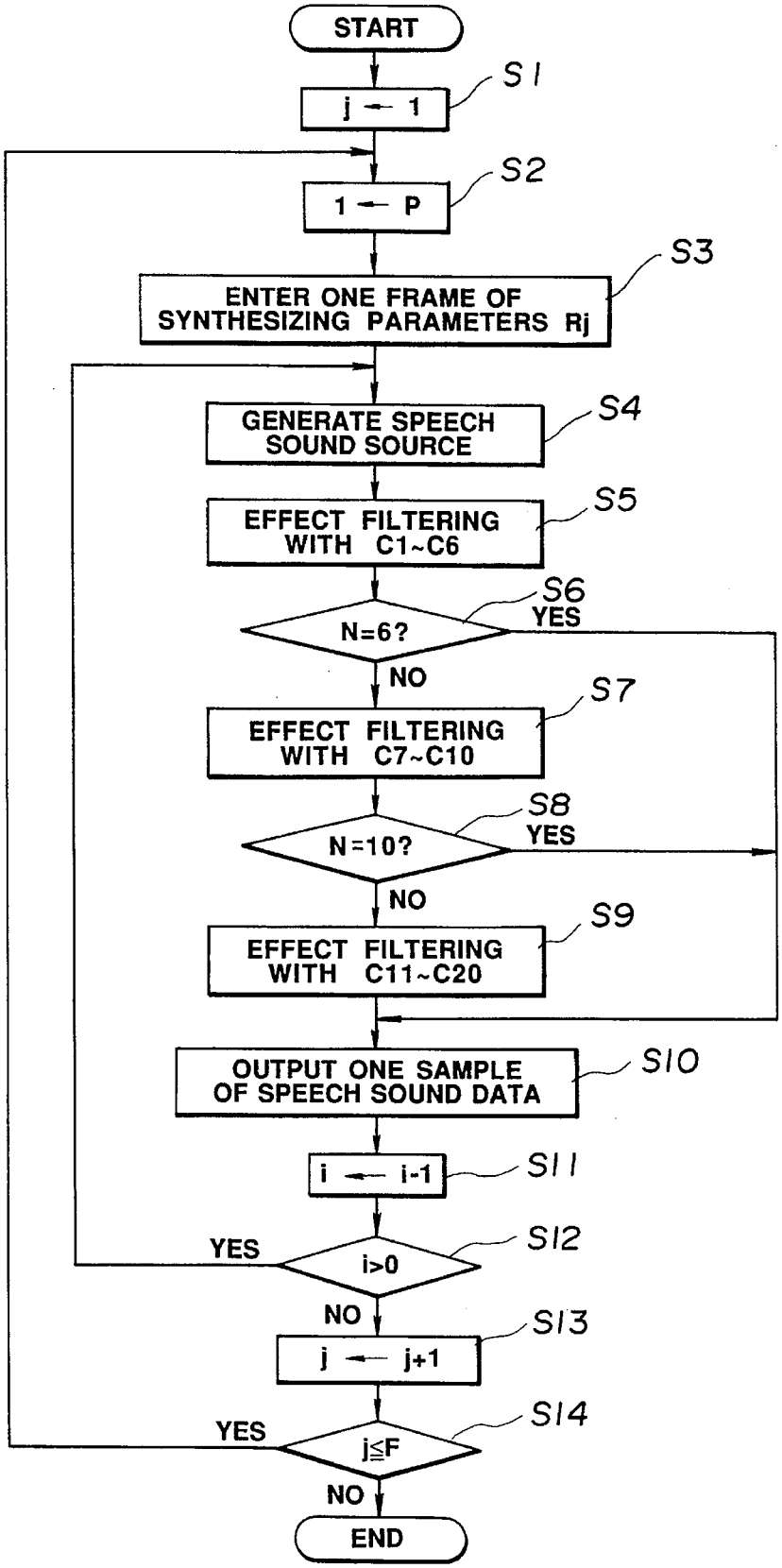
FIG. 2 is a flowchart of a processing sequence of a speech synthesizer of the speech synthesizing apparatus shown in FIG. 1.

The processing sequence of the speech synthesizer 6 will be described in detail below with reference to FIG. 2.

The speech synthesizer 6 sets a counter variable j indicating a frame number to an initial value of "1" in a step S1 and also sets a counter variable i indicating the remaining number of samples to be processed per frame to an initial value of "P"=frame period/sampling period in a step S2. The sampling period is the same as the period of a clock signal supplied to the D/A converter (not shown).

Thereafter, the speech synthesizer 6 selectively enters, in a step S3, synthetic parameters Rj composed of one frame (whose frame number is "j") of phonetic parameters C0~CN and prosodic parameters, which one frame corresponds to the order N indicated by the order information supplied from the input unit 1, from the phonetic and prosodic parameters which have been supplied from the synthetic parameter generator 5 and held therein.

Then, the speech synthesizer 6 generates one sample of speech waveform data, i.e., a sound source, using the phonetic parameter C0 and the prosodic parameters in a step S4. After the step S4, the speech synthesizer 6 effects filtering, i.e., digital filtering, on the generated sample of speech waveform data using the phonetic parameters C1~C6 in a step S5.

Thereafter, the speech synthesizer 6 determines whether the order N indicated by the order information supplied from the input unit 1 is "6" or not in a step S6. If the order N is "6" then the speech synthesizer 6 outputs the filtered sample of speech waveform data in a step S10.

If the order N is not "6" in the step S6, then the speech synthesizer 6 effects filtering on the sample of speech waveform data generated in the step S5, using the phonetic parameters C7~C10 in a step S7. The speech synthesizer 6 then determines whether the order N is "10" or not in a step S8.

If the order N is "10", then control jumps from the step S8 to the step S10. If the order N is other than "10", then the speech synthesizer 6 effects filtering on the sample of speech waveform data generated in the step S7, using the phonetic parameters C11~C20 in a step S9. Thereafter, control proceeds from the step S9 to the step S10.

As described above, if the order N indicated by the order information is "6" the speech synthesizer 6 effects filtering on the sample of speech waveform data using the phonetic parameters C1~C6. If the order N indicated by the order information is "10", the speech synthesizer 6 effects filtering on the sample of speech waveform data using the phonetic parameters C1~C7. Otherwise, the speech synthesizer 6 effects filtering on the sample of speech waveform data using the phonetic parameters C1~C20.

After the step S10, the speech synthesizer 6 decrements the counter variable i by "1" in a step S11. The speech synthesizer 6 determines whether the counter variable i is greater than "0" or not in a step S12. If the counter variable i is greater than "0", then control goes back to the step S4 for generating a next sample of speech waveform data and filtering the sample of speech waveform data. If the counter variable i is not greater than "0" i.e., if the steps S4~S12 have been executed for processing P samples (P=frame period/sampling period) of speech waveform data, then the speech synthesizer 6 increments the counter variable j indicative of the frame number by "1" in a step S13.

Therefore, the speech synthesizer 6 executes the steps S4~S12 P times to generate one frame (=P samples) of speech waveform data. If one frame of speech waveform data has been generated, i.e., if the counter variable i is not greater than "0", then the speech synthesizer 6 determines in a step S14 whether or not the counter variable j is equal to or smaller than a frame number "F" which indicates the number of frames to be converted into speech. If the counter variable j is equal to or smaller than "F", then control returns to the step S2 for the generation of a next frame of speech waveform data. If the counter variable j is greater than "F" then the processing sequence shown in FIG. 2 is brought to an end.

As described above, the speech synthesizer 6 executes the steps S2~S14 F times to generate F frames of speech waveform data. In the flowchart of FIG. 2, the sample of speech waveform data is filtered using the phonetic parameters C1~C20 unless the order N is 6 or 10. In this embodiment, the order N that can be indicated by the order information entered through the input unit 1 is limited to 6, 10, and 20, and other orders are not indicated by the order information.

An example of speech synthesis according to the processing sequence shown in FIG. 2 will be described below. It is assumed that the order information indicative of the order "20" (N=20) is entered through the input unit 1. If the sampling period is 125 μs and the frame period is 10 ms, then P in FIG. 2 is "80". It is also assumed that the speech segment file 4 stores cepstral parameters CO~C20 corresponding to each of the syllables of the series of phonetic symbols generated by the linguistic processor 3.

The synthetic parameter generator 5 extracts, from the speech segment file 4, cepstral parameters C0~C20 with respect to the order N corresponding to each of the syllables of the generated series of phonetic symbols, and generates prosodic parameters according to the prosodic information. If the number F of all frames is 500, then there are 21×50=10500 phonetic parameters and 500 prosodic parameters.

Thereafter, the speech synthesizer 6 enters synthetic parameters R1 composed of a first frame of phonetic parameters CO~C20 and prosodic parameters from the 10500 phonetic parameters and the 500 prosodic parameters produced by the synthetic parameter generator 5 in the step S3, and then generates a sound source based on the phonetic parameter CO and the prosodic parameters in the step S4. The speech synthesizer 6 supplies the sound source to a synthesizing filter, and effects filtering on the speech waveform data using the phonetic parameters C1~C20 in the steps S5~S12. The speech synthesizer 6 executes the above steps S4~S12 80 times, i.e., for 80 samples.

Subsequently, the speech synthesizer 6 enters a next frame of synthetic parameters R2 in the step S3, and carries out the steps S4~S12 80 times again for the next frame. The speech synthesizer 6 executes the above frame sequence of steps S4~S12 500 times, i.e., for 500 frames. One sample of speech waveform data is outputted in the step S10 in each loop of the processing sequence.

In the above example, using the phonetic parameters C1~C20, filtering is effected on the sound source F×P=500×80=4000 times. If a time T1 is required to effect one filtering process using the phonetic parameters C1~C6 (steps S5, S6), a time T2 is required to effect one filtering process using the phonetic parameters C7~C10 (steps S7, S8), a time T3 is required to effect one filtering process using the phonetic parameters C11~C20 (step S9), and a time T4 is required to effect the other steps of the processing sequence shown in FIG. 5, then the total period of time required for the speech synthesizer 6 to generate speech waveform data for 5 seconds corresponding to 500 frames each having a period of 10 ms is 4000×(T1+T2+T3)+T4.

In another example, the order N indicated by the order information is "6" and the other conditions are the same as above. Therefore, cepstral parameters C0~C6 are extracted from the speech segment file 4, and hence there are produced 7×500=3500 phonetic parameters. Since N=6, the steps S7~S9 are not executed by the speech synthesizer 6. The total period of time required for the speech synthesizer 6 to generate speech waveform data for 5 seconds is 4000×T1+T4, which is shorter than if N=20 by 4000×(T2+T3).

Generally, the higher the order of cepstral parameters, the sharper the spectral envelope of frequencies, and the lower the order of cepstral parameters, the less sharp the spectral envelope of frequencies. Stated otherwise, as the order is higher, speech sounds of higher quality are generated, and as the order is lower, speech sounds of lower quality are generated. Therefore, speech sounds of different qualities can be generated by selecting different orders. If the user hears synthesized speech continuously for a long period of time, a lower order may be selected.

The speech synthesizing apparatus according to the first embodiment is capable of increasing or reducing the amount of synthesizing filtering calculations depending on the order of phonetic parameters, and is also capable of varying the quality of generated synthesized speech by varying the order of phonetic parameters.

In the first embodiment, one of the three predetermined orders of cepstral parameters is directly indicated by the order information that is entered through the input unit 1. However, instead of entering such order information, information such as "1", "2", "3" or "A", "B", "C" indicative of the quality of synthesized speech may be entered, and may be associated with the order of phonetic parameters in the speech synthesizing apparatus. The orders that can be indicated by the order information are not limited to the three orders.

While the generation of synthetic parameters, the generation of a sound source, and the synthesizing filtering are software-implemented in the first embodiment, the principles of the invention are applicable to a system in which they are hardware-implemented where the quality of synthesized speech can also be varied by varying the order of phonetic parameters.

Figure 3:
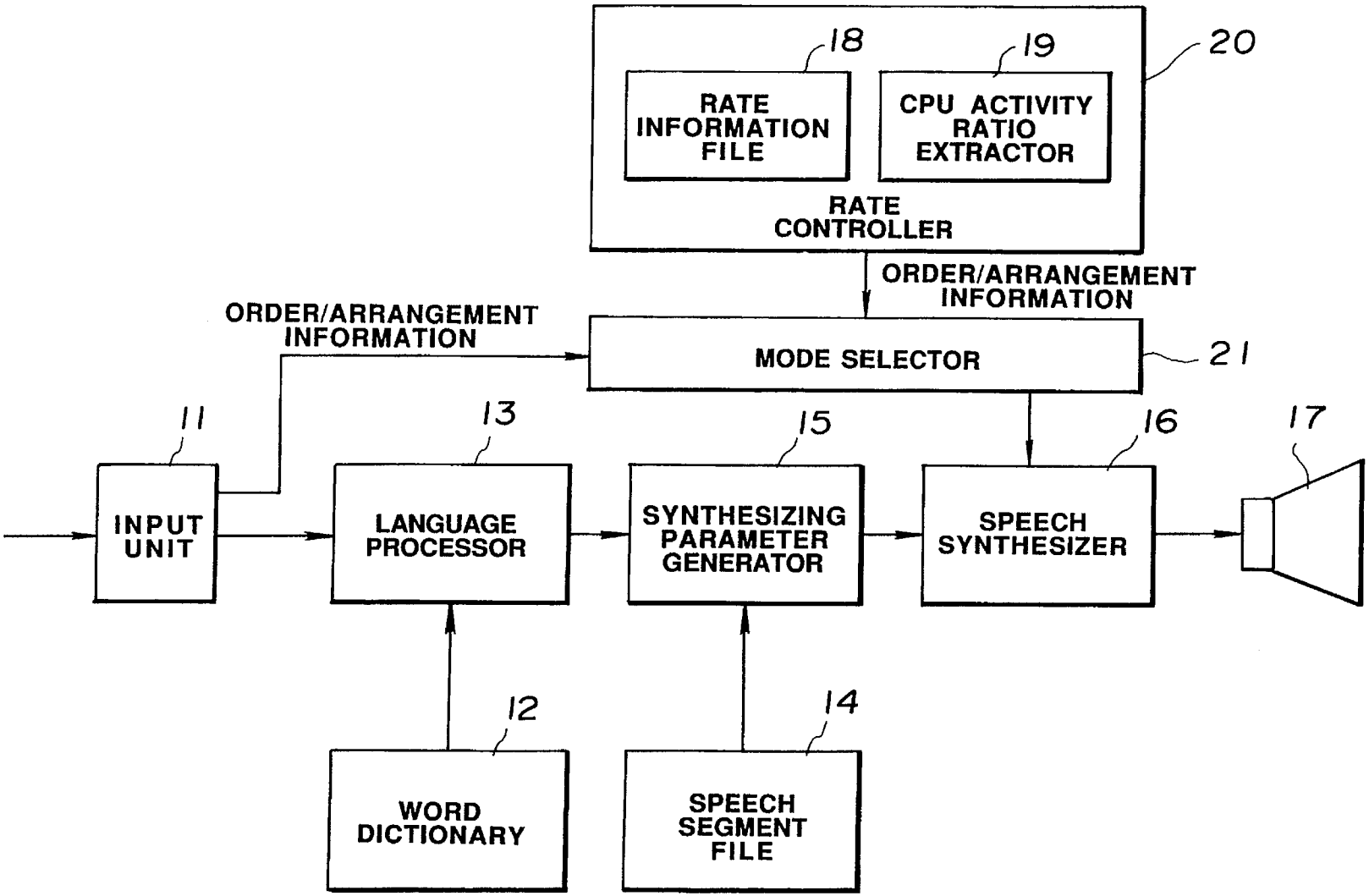
FIG. 3 is a block diagram of a speech synthesizing apparatus according to a second embodiment of the present invention.

2ND EMBODIMENT:

FIG. 3 shows in block form a speech synthesizing apparatus according to a second embodiment of the present invention. As shown in FIG. 3, the speech synthesizing apparatus includes an input unit 11 for entering a series of character codes representing a mixture of Kanji and Kana characters to be converted into synthesized speech and control information for controlling the synthesized speech. The control information comprises either order information to select the order N of synthetic parameters to be supplied to a filter in a speech synthesizer 16 (described later), or arrangement information indicating the arrangement of a synthesizing filter in the speech synthesizer 16.

The speech synthesizing apparatus shown in FIG. 3 also has a word dictionary 12, a linguistic processor 13, and a speech segment file 14 which are identical to the word dictionary 2, the linguistic processor 3, and the speech segment file 4, respectively, shown in FIG. 1. The speech synthesizing apparatus further includes a synthetic parameter generator 15 for generating phonetic parameters, i.e., phonetic cepstral parameters, according to the series of phonetic symbols generated by the linguistic processor 13 and predetermined order information indicative of an order 20. The synthetic parameter generator 15 also serves to generate prosodic parameters according to the prosodic information generated by the linguistic processor 13.

The speech synthesizing apparatus shown in FIG. 3 also has a speech synthesizer 16 and a loudspeaker 17 for outputting generated synthesized speech. The speech synthesizer 16 generates a sound source based on the phonetic parameters generated by the synthetic parameter generator 15, the order information, and the prosodic parameters generated by the synthetic parameter generator 15, and effects filtering on the generated sound source with either an Nth-order filter according to the order information supplied from a mode selector 21 or a filter arrangement selected according to the arrangement information supplied from the mode selector 21, to generate synthesized speech. The speech synthesizer 16 includes a D/A converter (not shown) for converting the synthesized speech into an analog signal.

The speech synthesizing apparatus shown in FIG. 3 additionally includes a rate information file 18 and a CPU activity ratio extractor 19. The rate information file 18 stores information representing either an order of phonetic parameters which corresponds to a CPU activity ratio or the arrangement of a filter in the speech synthesizer 16, mode selecting information indicative of whether order or arrangement information is to be selected from the input unit 11 or a rate controller 20, and timing information representing the timing to extract the CPU activity ratio. The CPU activity ratio extractor 19 serves to extract a CPU activity ratio with respect to tasks other than a speech synthesis task each time it is instructed to do so by the rate controller 20. The CPU activity ratio may be determined, for example, by detecting process IDs of tasks other than the speech synthesis task, extracting CPU activity ratios of the respective process IDs that have been detected, and adding all the extracted CPU activity ratios. Alternatively, the CPU activity ratio may be determined by extracting CPU activity ratios of all tasks while the speech synthesizing process is being temporarily interrupted.

The rate controller 20 obtains, from the rate information file 18, order or arrangement information corresponding to the CPU activity ratio determined by the CPU activity ratio extractor 19, and supplies the order or arrangement information to the mode selector 21. The rate controller 20 also refers to the timing information in the rate information file 18, and gives an instruction to extract a CPU activity ratio according to the timing information to the CPU activity ratio extractor 19. The mode selector 21 selects either one of the order or arrangement information supplied from the input unit 11 and the order or arrangement information supplied from the rate controller 20 based on the mode selecting information stored in the rate information file 18, and supplies the selected order or arrangement information to the speech synthesizer 16.

As with the speech synthesizing apparatus shown in FIG. 1, the speech synthesizing apparatus shown in FIG. 3 is realized by a personal computer (PC) or an engineering work station (EWS). The input unit 11, the linguistic processor 13, the synthetic parameter generator 15, the speech synthesizer 16, the CPU activity ratio extractor 19, the rate controller 20, and the mode selector 21 are functional blocks whose functions are performed by a programmed sequence of a CPU of the personal computer or the engineering work station, i.e., by the execution of a speech synthesis task.

Figure 4:
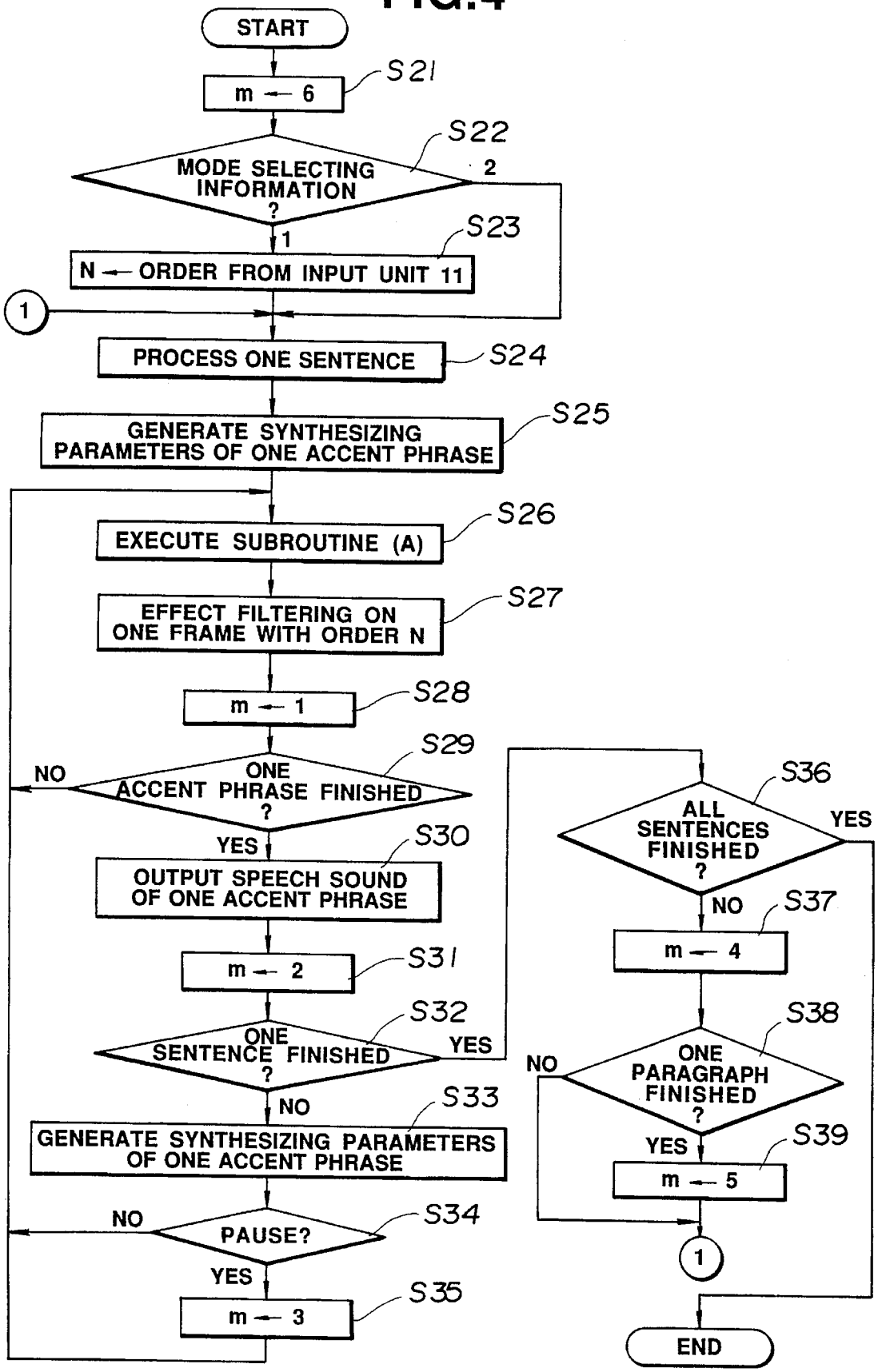
FIG. 4 is a flowchart of a processing sequence of a speech synthesizer of the speech synthesizing apparatus shown in FIG. 3.
Figure 5:
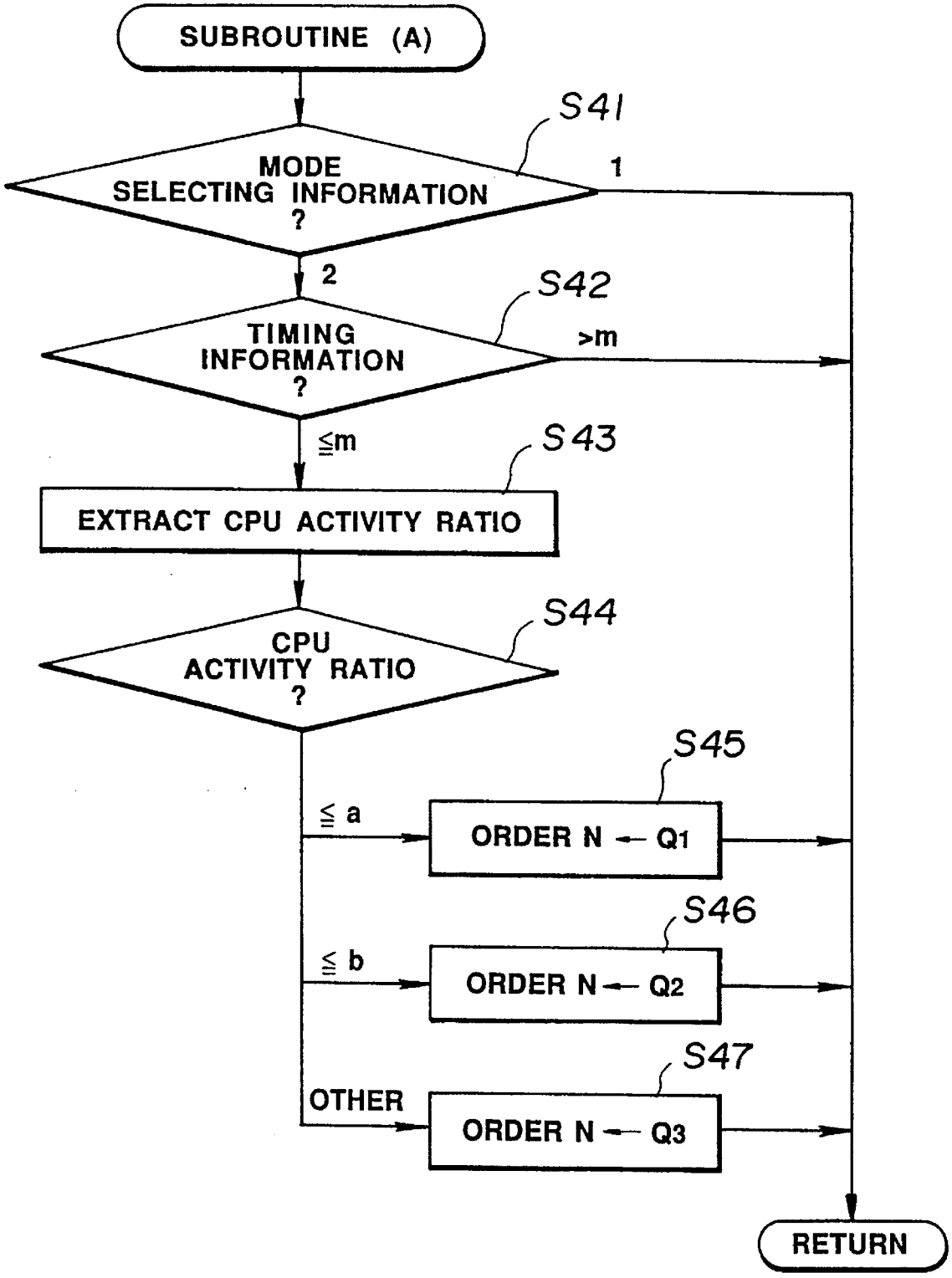
FIG. 5 is a flowchart of a subroutine (A) in the processing sequence shown in FIG. 4.

Operation of the speech synthesizing apparatus shown in FIG. 3 will be described below with reference to the flowchart shown in FIGS. 4 and 5. FIG. 4 shows a processing sequence for varying the processing rate of a speech synthesizing process by varying the order of phonetic parameters. FIG. 5 shows a subroutine (A) in the processing sequence shown in FIG. 4.

As shown in FIG. 6A, the rate information file 18 stores data about average processing rates P required to generate real-time synthesized speech depending on the order N of phonetic parameters which may be Q1=20, Q2=10, or Q3=6). Specifically, the average processing rate P is P1=29 when the order N is Q1=20, the average processing rate P is P2=20 when the order N is Q2=10, and the average processing rate P is P3=10 when the order N is Q3=6. When the speech synthesizing process is carried out with the order N being Q1=20, Q2=10, and Q3=6, the activity ratios of the CPU available for performing processes other than the speech synthesizing process have respective upper limits a, b, c that are given as follows:

a=100%−(processing rate P1/CPU rate)×100%;

b=100%−(processing rate P2/CPU rate)×100%; and c=100%−(processing rate P3/CPU rate)×100%.

Therefore, if the CPU rate is 30 MIPS, then since P1=29, P2=20, and P3=10, the upper limits a, b, c of the activity ratios of the CPU for other processes or tasks than the speech synthesizing process when the speech synthesizing process is carried out with the order N being Q1=20, Q2=10, and Q3=6, respectively, are 3%, 33%, and 67%, respectively. Consequently, when the CPU activity ratios for other tasks than the speech synthesizing process exceed a=3%, b=33%, and c=67%, respectively, it is not possible to generate synthetic speed on a real-time basis with the order N being Q1=20, Q2=10, and Q3=6, respectively.

As shown in FIG. 6B, the rate information file 18 also stores mode selecting information which may be either "1" indicating that the order or arrangement information supplied from the input unit 11 is to be selected or "2" indicating that the order or arrangement information supplied from the rate controller 20 is to be selected. The rate information file 18 also stores timing information which may be either "1" indicating that the CPU activity ratio is to be extracted in every frame, or "2" indicating that the CPU activity ratio is to be extracted in every accent, or "3" indicating that the CPU activity ratio is to be extracted in every accent sandwiched between pauses, or "4" indicating that the CPU activity ratio is to be extracted in every sentence, or "5" indicating that the CPU activity ratio is to be extracted in every paragraph, or "6" indicating that the CPU activity ratio is to be extracted only once at the beginning of the speech synthesizing process.

As shown in FIG. 4, the rate controller 20 sets a variable m to an initial value of "6" in a step S21. The variable m is used in a step S42 (described later on) to determine whether the CPU activity ratio is to be extracted or not.

After the step S21, the rate controller 20 determines whether the mode selecting information stored in the rate information file 18 is "1" or "2" in a step S22.

If the mode selecting information is "1" then the order information supplied from the input unit 11 is made effective by the mode selector 21 in a step S23. If the mode selecting information is "2", then control jumps from the step S22 to a step S24.

Thereafter, when a series of character codes representing a sentence of mixed Kanji and Kana characters to be converted into synthesized speech is entered from the input unit 11, one sentence divided by a period or a line break is extracted from the entered series of character codes. The linguistic processor 13 compares the extracted sentence with the word dictionary 2 to determine accent types, pronunciations, and parts of speech of words and phrases represented by the sentence, determines accent types and boundaries according to the parts of speech, and converts the sentence of mixed Kanji and Kana characters into a pronunciation format, for thereby generating a series of phonetic symbols and prosodic information in the step S24.

The synthetic parameter generator 15 takes one accent phrase from the phonetic symbols and prosodic information generated by the linguistic processor 13, extracts phonetic cepstral parameters corresponding to the series of phonetic symbols in the accent phrase from the speech segment file 14, for thereby generating phonetic parameters, and generates prosodic parameters according to the prosodic information, in a step S25. At this time, the phonetic parameters are generated using the phonetic cepstral parameters of all orders (20) registered in the speech segment file 14, unlike the generation of phonetic parameters in the synthetic parameter generator 5 according to the first embodiment.

Thereafter, a subroutine (A) is executed in a step S26 as shown in FIG. 5.

First, the rate controller 20 checks the mode selecting information stored in the rate information file 18 in a step S41.

If the mode selecting information is "1" then control leaves the subroutine (A) and goes to a step S27 of the main routine shown in FIG. 4.

If the mode selecting information is "2" then the rate controller 20 checks the timing information stored in the rate information file 18 in a step S42.

If the timing information has a value greater than the present value ("6" at this time) of the variable m, then control leaves the subroutine (A) and goes to the step S27 of the main routine shown in FIG. 4.

If the timing information has a value equal to or smaller than the present value ("6" at this time) of the variable m, then the rate controller 20 controls the CPU activity ratio extractor 19 to extract the CPU activity ratio with respect to other tasks than the speech synthesizing process in a step S43. Thereafter, the rate controller 20 checks the CPU activity ratio extracted by the CPU activity ratio extractor 19 in a step S44. If the CPU activity ratio is equal to or smaller than a=3%, then the rate controller 20 sets the order N to Q1=20 in a step S45. If the CPU activity ratio is greater than a=3% and equal to or smaller than b=33%, then the rate controller 20 sets the order N to Q2=10 in a step S46. Otherwise, i.e., if the CPU activity ratio is greater than b=33% then the rate controller 20 sets the order N to Q3=6 in a step S47. After the step S45, S46, or S47, control returns to the step S27 shown in FIG. 4. If the CPU activity ratio is greater than c=67%, then it will be difficult to generate real-time synthesized speech even when the order N is set to "6".

As described above, the subroutine (A) shown in FIG. 5 is a sequence for setting the order N prior to speech synthesis if the mode selecting information is "2" and the timing information is equal to or smaller than "6".

In the step S27 shown in FIG. 4, the speech synthesizer 16 generates a sound source and effects digital filtering on one frame based on the synthetic parameters of one accent phrase which have been generated by the synthetic parameter generator 15 in the step S25, thus generating a speech waveform. At this time, the phonetic parameters with respect to the order N are extracted from the synthetic parameters, and the filtering is effected on the generated sound source using the phonetic parameters of the order N. If the mode selecting information is "1", the order N has been set to the value of the order information from the input unit 11 in the step S23. If the mode selecting information is "2" the order N has been set to the value determined in the step S45, S46, or S47 depending on the CPU activity ratio.

After the step S27, the speech synthesizer 16 sets the variable m to "1" in a step S28. Then, the speech synthesizer 16 determines whether the processing of one accent phrase is finished or not in a step S29. If not finished, then control goes back through the step S26 to the step S27 for filtering a next frame in the same accent phrase. If the processing of one accent phrase is finished in the step S29, then the speech synthesizer 16 converts the speech waveform of one accent phrase into an analog signal with a D/A converter (not shown), and outputs the analog signal to the loudspeaker 17 in a step S30. Actually, a next processing cycle is executed while the speech waveform data is being outputted to the loudspeaker 17.

The steps S26~S29 are repeatedly executed until all speech waveforms of one accent phrase are generated. In the step 26 (subroutine (A)) after the variable m is set to "1" in the step S28, the CPU activity ratio is extracted and the order with respect to the extracted CPU activity ratio is reset only when the mode selecting information is "2" and the timing information is of a value equal to or smaller than the variable m, i.e., "1". Otherwise, the order is not set. Therefore, when the timing information is "1", the CPU activity ratio is extracted and the order is set in every frame.

After the step S30, the speech synthesizer 16 sets the variable m to "2" in a step S31, and then determines whether the processing of one sentence is finished or not in a step S32. If finished, then the speech synthesizer 16 determines whether the processing of all sentences to be converted into synthesized speech is finished or not in a step S36. If the processing of one sentence is not finished in the step S32, then the synthetic parameter generator 15 generates synthetic parameters with respect to a next accent phrase in the sentence in a step S33. Thereafter, the synthetic parameter generator 15 determines whether there is a mark indicative of a pause between the accent phrase corresponding to the newly generated synthetic parameters and the preceding accent phrase in a step S34.

If there is not a mark indicative of a pause, then control goes back through the step S26 to the step S27. If there is a mark indicative of a pause, then the speech synthesizer 16 sets the variable m to "3" in a step S35, after which control goes back through the step S26 to the step S27 for filtering one next frame with respect to the same accent phrase.

If the step S26 (subroutine (A)) is executed after the variable m has been set to "2" in the step S31 and the steps S32, S33, S34 have been executed, the CPU activity ratio is extracted and the order with respect to the extracted CPU activity ratio is reset only when the mode selecting information is "2" and the timing information is of a value equal to or smaller than "2", as can be seen from the flowchart shown in FIG. 5. Otherwise, the order is not set. Therefore, when the timing information is "2", for example, the CPU activity ratio is extracted and the order is set in every accent phrase.

If the step S26 (subroutine (A)) is executed after the variable m has been set to "2" in the step S35, the CPU activity ratio is extracted and the order with respect to the extracted CPU activity ratio is reset only when the mode selecting information is "2" and the timing information is of a value equal to or smaller than "3". Otherwise, the order is not set. Therefore, when the timing information is "3" for example, the CPU activity ratio is extracted and the order is set in every accent phrase sandwiched between pauses.

The steps S26~S35 are repeatedly executed until the speech waveform of one sentence is generated. If the processing of one sentence is finished, then the speech synthesizer 16 determines whether the processing of all sentences entered through the input unit 11 is finished or not in a step S36. If finished, the speech synthesizing process is ended.

If the processing of all sentences is not finished, then the input unit 11 sets the variable m to "4" in a step S37, and then determines whether the processing of one paragraph is finished or not in a step S38. If not finished, then control returns to the step S24. If finished, then the input unit 11 sets the variable m to "5" in a step S39, and control returns to the step S24 in which the speech synthesizer 13 processes a next sentence. The detection of one paragraph in the step S38 is carried out when the end of the sentence is accompanied by a line break and the next line is indented.

If the step S26 (subroutine (A)) is executed after the variable m has been set to "4" in the step S37 and the steps S38, S24, S25 have been executed, the CPU activity ratio is extracted and the order with respect to the extracted CPU activity ratio is reset only when the mode selecting information is "2" and the timing information is of a value equal to or smaller than "4", as can be seen from the flowchart shown in FIG. 5. Otherwise, the order is not set Therefore, when the timing information is "4" for example, the CPU activity ratio is extracted and the order is set in every sentence.

If the step S26 (subroutine (A)) is executed after the variable m has been set to "5" in the step S39 and the steps S24, S25 have been executed, the CPU activity ratio is extracted and the order with respect to the extracted CPU activity ratio is reset only when the mode selecting information is "2" and the timing information is of a value equal to or smaller than "5". Otherwise, the order is not set Therefore, when the timing information is "5" for example, the CPU activity ratio is extracted and the order is set in every paragraph.

An example of speech synthesis effected by the speech synthesizing apparatus shown in FIG. 3 will be described below. In this example, Japanese sentences "Kondono kaigiwa, 5 gatsu 10 kani kimarimashita. Tsugouno waruikatawa, yamadamade oshirasekudasai.", which means "The next meeting will be held on May 10. Anybody who cannot make it should notify Yamada.", as shown in FIG. 7A, are entered through the input unit 11. After the sentences shown in FIG. 7A are entered and until the corresponding synthesized speech output is produced, the CPU activity ratio varies with time as shown in FIGS. 7B and 7C. It is assumed that both the mode selecting information and the timing information stored in the rate information file 18 are "2".

First, the variable m is set to "6" in the step S21. Since the mode selecting information is "2", control jumps from the step S22 to the step S24. In the step S24, the input unit 11 detects the sentence "Kondono kaigiwa, 5 gatsu 10 kani kimarimashita.", and the linguistic processor 13 generates a series of phonetic and prosodic symbols "Ko^ndono/ka^igiwa../go^gatsu/toukani./kimarima^shita...//" as shown in FIG. 7B, from the sentence. In the series of phonetic and prosodic symbols, the mark "^" indicates an accent position, the mark "/" indicates the end of an accent phrase, and the mark "." indicates a pause (unvoiced interval).

Then, a first accent phrase "Ko^ndono" is taken out of the series of phonetic and prosodic symbols shown in FIG. 7B, and its synthetic parameters are generated by the synthetic parameter generator 15 in the step S25.

Thereafter, the step 26, i.e., the subroutine (A), is executed. Inasmuch as the mode selecting information is "2" and the timing information is "2" control goes successively through the steps S41, S42, S43, S44. The CPU activity ratio, extracted in the step S43, with respect to other tasks than the speech synthesizing process is indicated by y1 in FIG. 7B and less than a=3%. Therefore, control goes from the step S44 to the step S45 in which the order N is set to Q1=20. Then, filtering is effected on one frame with the order N=20 in the step S27.

The steps S26, S27, S28, S29 are repeated until a speech waveform corresponding to the accent phrase "Ko^ndono" is generated. During this time, the variable m is set to "1" and the subroutine (A) is executed. Since the timing information is neither equal to nor smaller than "1", however, the CPU activity ratio is not extracted and the order N is not set to a new value. The generated speech waveform of the accent phrase is transferred to the non-illustrated D/A converter, and its speech sound is outputted by the loudspeaker 17 in the step S30.

After the variable m is set to "2" in the step S31, it is determined whether the processing of one sentence is finished in the step S32. Since the processing of one sentence is not finished, synthetic parameters with respect to next accent phrase "ka^igiwa" are generated in the step S33. The step S34 determines whether there is a pause mark between the preceding accent phrase "Ko^ndono" and the new accent phrase "ka^igiwa". Inasmuch as there is no accent mark, control goes back to the subroutine (A) in the step S26.

Since m=2, the steps S41, S42, S43 are executed in the subroutine (A). The CPU activity ratio, extracted in the step S43, with respect to other tasks than the speech synthesizing process is indicated by y2 in FIG. 7B and greater than b=33%. Therefore, control goes from the step S44 to the step S47 in which the order N is set to Q3=6.

Then, the steps S27~S33 are executed. In the next step S34, there is a pause mark between the accent phrase "ka^igiwa" and a next accent phrase "go^gatsu". Consequently, the variable m is set to "3" in the step S35.

Control returns from the step S35 to the subroutine (A) in the step S26. As the mode selecting information is "2" and the timing information is "2" the steps S41, S42, S43 are executed. The CPU activity ratio, extracted in the step S43, with respect to other tasks than the speech synthesizing process is indicated by y3 in FIG. 7B and greater than a=3% and smaller than b=33%. Therefore, control goes from the step S44 to the step S46 in which the order N is set to Q2=10.

The same processing is carried out until the synthesized speech of the phrase "kimarima^shita...//" is outputted in the step S30. Then, the step S32 after the step S31 determines that the processing of one sentence is finished. Control goes through the steps S36, S37 to the step S38 which determines whether one paragraph is finished or not. As there is no paragraph, control returns from the step S38 to the step S24.

In this manner, the synthesized speech of the series of phonetic and prosodic symbols "Ko^ndono/ ka^igiwa../ go^gatsu/toukani./kimarima^shita...//" as shown in FIG. 7B is generated by synthesizing filtering with the orders N as shown in FIG. 7D. The next series of phonetic and prosodic symbols "Tsugouno/waru^ikatawa..yamadama^de./ oshirasekudasa^i...//" is then processed similarly, and synthesizing filtering is carried out with the orders N as shown in FIG. 7E, thereby producing the corresponding synthesized speech.

In the above example, the timing information is "2". If the timing information is "3", then synthesizing filtering is carried out with the orders N as indicated below upper underlines in FIGS. 7F and 7G, to generate synthesized speech. If the timing information is "4", then synthesizing filtering is carried out with the orders N as indicated below lower underlines in FIGS. 7F and 7G, to generate synthesized speech.

In the above example, the processing rate of the speech synthesizing process is varied by varying the degree of phonetic parameters for synthetic filtering. However, the processing rate of the speech synthesizing process may be varied by varying the internal arrangement of the synthesizing filter of the speech synthesizer.

A speech synthesizing apparatus in which the processing rate of a speech synthesizing process can be varied by varying the internal arrangement of a synthesizing filter will be described below. This speech synthesizing apparatus is similar to the speech synthesizing apparatus shown in FIG. 3 except for a speech synthesizer. More specifically, phonetic parameters used for speech synthesis comprise cepstral parameters produced as a result of a cepstral analysis, and speech sounds are synthesized by log magnitude approximation (LMA) filters whose coefficients are directly provided by such cepstral parameters. In this speech synthesizing apparatus, the speech synthesizer corresponding to the speech synthesizer 16 shown in FIG. 3 has such LMA filters.

Figures 8, 9:
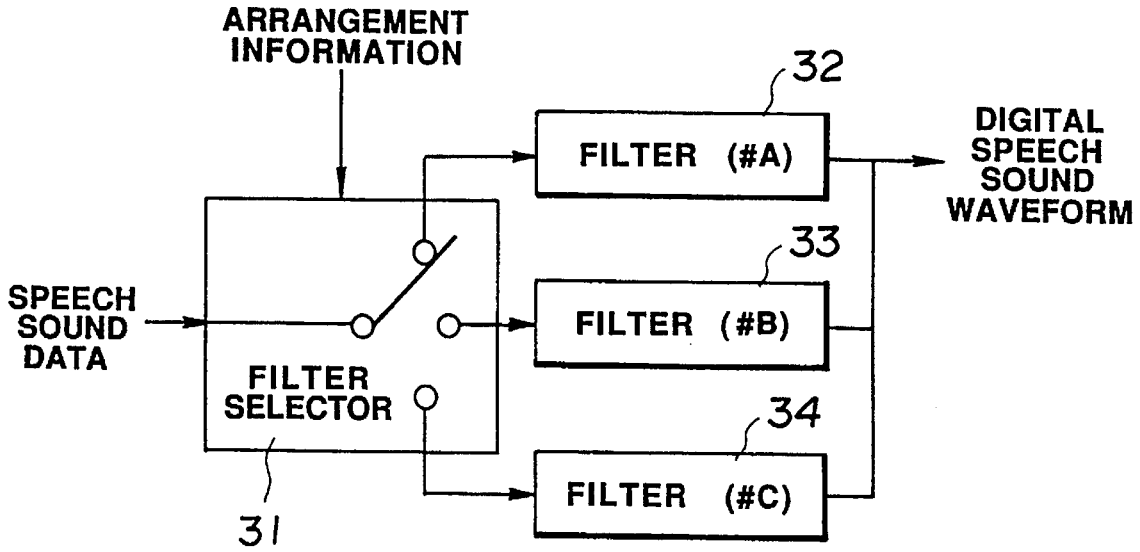
FIG. 8 is a block diagram of a filter arrangement which may be employed in the speech synthesizer of the speech synthesizing apparatus shown in FIG. 3.
FIG. 9 is a diagram showing examples of information stored in the rate information file which are necessary to vary the processing time with filter switching in the speech synthesizing apparatus shown in FIG. 3.

Specifically, the speech synthesizer includes, as shown in FIG. 8, a filter selector 31 and three synthesis units or filters selectable by the filter selector 31, i.e., a filter (#A) 32, a filter (#B) 33, and a filter (#C) 34.

Speech waveform data generated in the speech synthesizer is applied to the filter selector 31, which is supplied with arrangement information indicative of a filter (F) to be used from the mode selector 21. The arrangement information is produced by a process corresponding to the order setting process in the steps S45, S46, S47 shown in FIG. 5.

Based on the arrangement information from the mode selector 21, the filter selector 31 selects one of the filter (#A) 32, the filter (#B) 33, and the filter (#C) 34, and supplies the speech waveform data to the selected filter. The speech waveform data is thus filtered by the selected filter, which outputs speech waveform data.

Transfer functions $H_A(z)$, $H_B(z)$, $H_C(z)$ and a modified PADE approximation function $R^{(N)}{}_{(w)}$ of an exponential function exp(w) of the above three filters 32, 33, 34 are given below. In the equations below, the filters 32, 33, 34 are indicated as filters A, B, C, respectively, for the sake of brevity.

$$H_A(z) \text{ of Filter } A = (R^{(2)}(C_1Z^{-1})R^{(1)}(C_2Z^{-2})R^{(1)}(C_3Z^{-3}) \cdot R^{(1)}(C_4Z^{-4}+C_5Z^{-5})R^{(1)}(C_6Z^{-6}+C_7Z^{-7}+C_8Z^{-8}) \cdot R^{(1)}(C_9Z^{-9}+C_{10}Z^{-10}+\ldots+C_{14}Z^{-14}) \cdot R^{(1)}(C_{15}Z^{-15}+C_{16}Z^{-16}+\ldots+C_{20}Z^{-20}).$$

$$H_B(z) \text{ of Filter } B = (R^{(4)}(C_1Z^{-1})R^{(2)}(C_2Z^{-2})R^{(2)}(C_3Z^{-3}) \cdot R^{(2)}(C_4Z^{-4}+C_5Z^{-5})R^{(2)}(C_6Z^{-6}+C_7Z^{-7}+C_8Z^{-8}) \cdot R^{(2)}(C_9Z^{-9}+C_{10}Z^{-10}+\ldots+C_{14}Z^{-14}) \cdot R^{(2)}(C_{15}Z^{-15}+C_{16}Z^{-16}+\ldots+C_{20}Z^{-20}).$$

$$H_C(z) \text{ of Filter } C = (R^{(8)}(C_1Z^{-1})R^{(4)}(C_2Z^{-2})R^{(4)}(C_3Z^{-3}) \cdot R^{(4)}(C_4Z^{-4}+C_5Z^{-5})R^{(4)}(C_6Z^{-6}+C_7Z^{-7}+C_8Z^{-8}) \cdot R^{(4)}(C_9Z^{-9}+C_{10}Z^{-10}+\ldots+C_{14}Z^{-14}) \cdot R^{(1)}(C_{15}Z^{-15}+C_{16}Z^{-16}+\ldots+C_{20}Z^{-20}).$$

$$R^{(N)}_{(w)} = \frac{1+\sum_{n=1}^{N} A_{Nn}w^n}{1+\sum_{n=1}^{N}(-1)^n A_{Nn}w^n}$$

$$A_{Nn} = \frac{A_n^{(N)}\binom{N}{n}}{n!\binom{2N}{n}}$$

where $c_m$: cepstral parameters;

$R^{(N)}{}_{(w)}$: modified PADE approximation equation of an exponential function exp (w);

N: order of the modified PADE approximation equation; and $A_{Nn}$: filter coefficients.

As can be seen from the above equations, the filter (#B) 33 is equal to the filter (#A) 32 with the order of its modified PADE approximation equation being doubled, and the filter (#C) 34 is equal to the filter (#A) 32 with the order of its modified PADE approximation equation being quadrupled (C15~C20 are of first order).

Generally, in order to reduce an approximation error, it is necessary to either increase the order of the modified PADE approximation equation or reduce the value of a basic filter w. In general, the value of cepstral parameters is greater as the order thereof is smaller.

Therefore, a cepstral parameter C1 of a larger value is composed of the order of a modified PADE approximation equation which is greater than those of other modified PADE approximation equations. Conversely, as the order of a cepstral parameter increases, it is composed of the smaller order of a modified PADE approximation equation. Furthermore, some cepstral parameters are composed of one basic filter. The approximation error of the filter (#C) 34 is smaller, i.e., the quality of synthesized speech generated thereby is higher, than the other filters. However, since the order of the modified PADE approximation equation of the filter (#C) 34 is higher, the amount of calculations effected by the filter (#C) 34, i.e., the time required for filtering by the filter (#C) 34, is greater. On the other hand, the approximation error of the filter (#A) 32 is greater, i.e., the quality of synthesized speech generated thereby is lower, than the other filters. However, since the order of the modified PADE approximation equation of the filter (#A) 32 is lower, the amount of calculations effected by the filter (#A) 32, i.e., the time required for filtering by the filter (#A) 32, is smaller.

Figure 10:
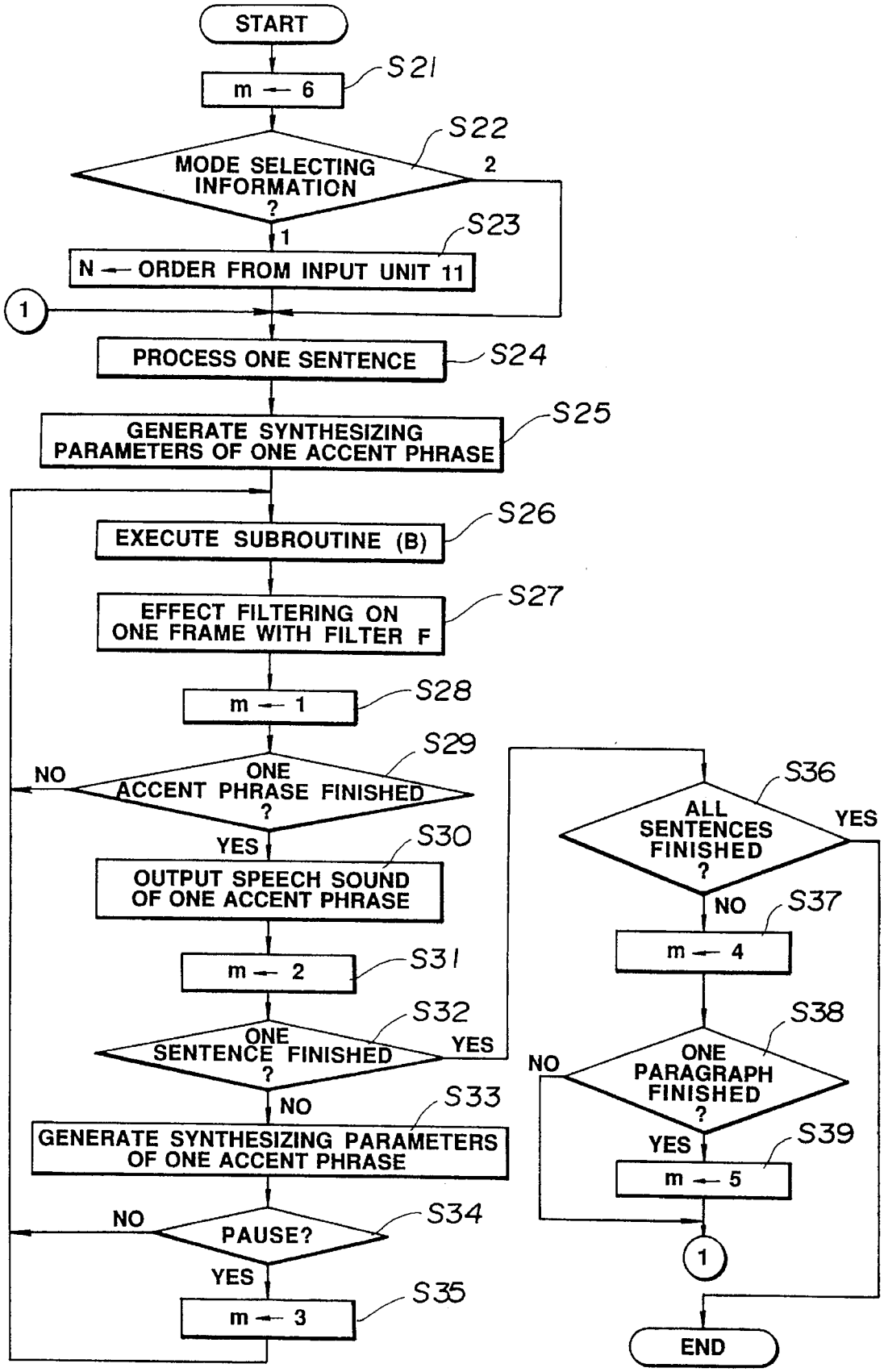
FIG. 10 is a flowchart of a processing sequence of a speech synthesizer of the speech synthesizing apparatus shown in FIGS. 3 and 8.
Figure 11:
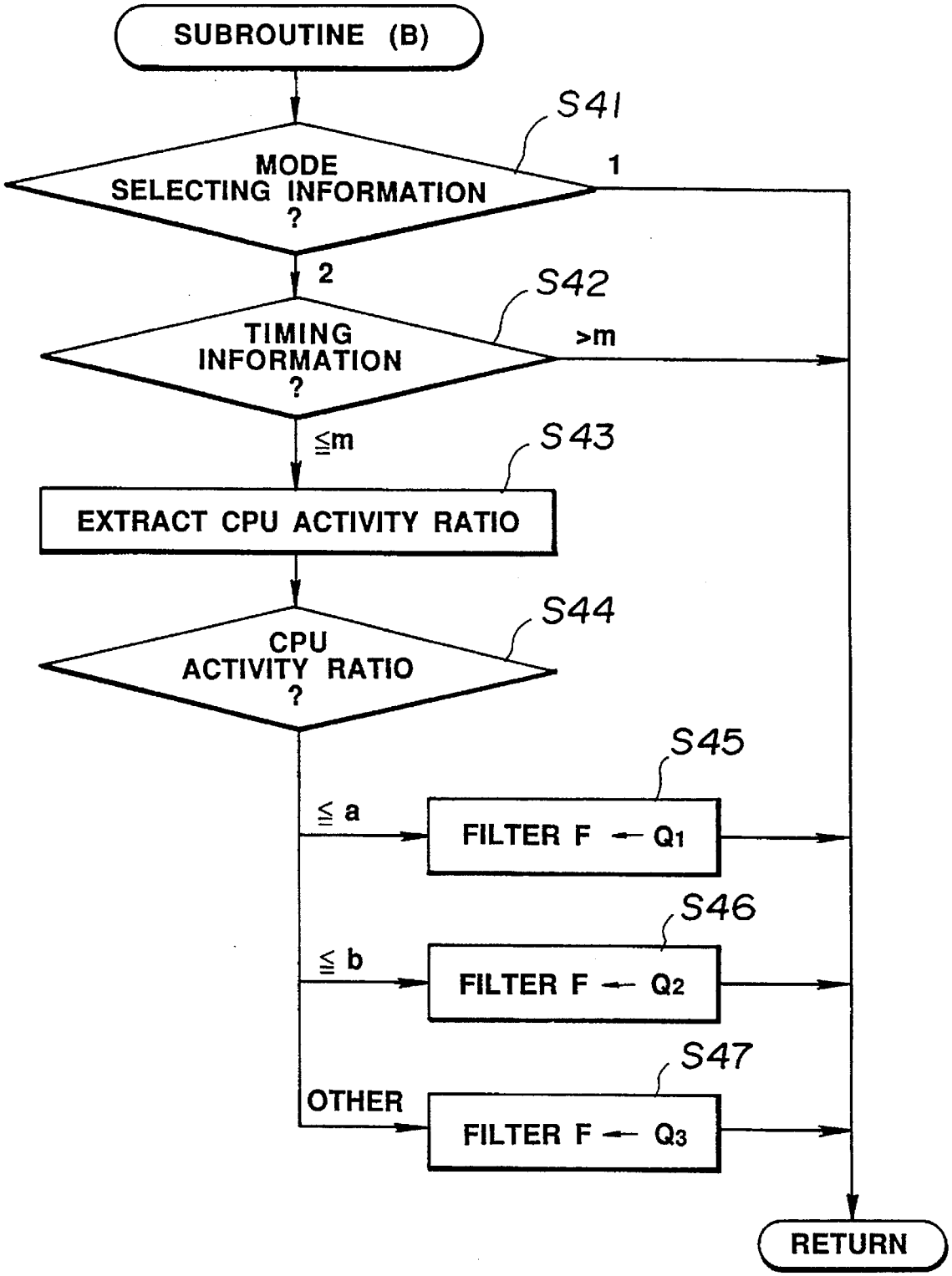
FIG. 11 is a flowchart of a subroutine (B) in the processing sequence shown in FIG. 10.

The rate information file 13 shown in FIG. 3 stores information representing the relationship between the filters 32, 33, 34 and processing rates required for speech synthesis as shown in FIG. 9. In operation, the speech synthesizing apparatus employs this information stored in the rate information file 13 and the information shown in FIG. 6B, and the speech synthesizer executes the flowcharts shown in FIGS. 10 and 11 for varying the processing time in the same manner as when the processing time is varied with the order of phonetic parameters as described above with reference to FIGS. 4 and 5.

The speech synthesizing apparatus shown in FIGS. 3 through 11 extract the CPU activity ratio of other tasks than the speech synthesizing process at certain timing, determine the order of phonetic parameters or a filter arrangement based on the extracted CPU activity ratio, and carry out filtering using the determined order or filter arrangement. Therefore, the speech synthesizing apparatus can generate real-time synthesized speech even if the CPU activity ratio of other tasks than the speech synthesizing process varies during the speech synthesizing process.

In the speech synthesizing apparatus shown in FIGS. 3 through 11, there are three orders or filters that can be selected. However, there may be employed more or less orders or filters that can be selected.

In the embodiment shown in FIGS. 8 through 11, the filter arrangement is varied by varying the order of the modified PADE approximation equation. However, the basic filter w may be varied. While the order of phonetic parameters and the filter arrangement are independently varied depending on the CPU activity ratio in the illustrated embodiments, the filter arrangement may be varied depending on the order of phonetic parameters.

The CPU activity ratio extractor 9 shown in FIG. 3 extracts the CPU activity ratio of other tasks than the speech synthesizing process. However, the CPU activity ratio extractor 9 may extract the CPU activity ratio of all tasks including the speech synthesizing process so that the CPU activity ratio of the speech synthesizing process is also included for the purpose of determining the order of phonetic parameters or the filter for speech synthesis.

In the illustrated embodiments, the order of phonetic parameters or the filter arrangement is determined either in an automatic mode in which it is determined depending on the extracted CPU activity ratio or a manual mode in which it is entered through the input unit 11 by the user. The automatic mode or the manual mode is selected according to the mode selecting information stored in the rate information file 18. However, the speech synthesizing apparatus may normally effect a speech synthesizing process in the automatic mode, and may carry out a speech synthesizing process according to information that is entered through the input unit 11.

While cepstral parameters are employed as phonetic parameters in the illustrated embodiments, other phonetic parameters such as LSP parameters, formant frequencies, or the like may be employed. For LSP synthesis or formant synthesis, there are required a plurality of speech segment files corresponding to respective orders for analysis.

Although certain preferred embodiments of the present invention have been shown and described in detail, it should be understood that various changes and modifications may be made therein without departing from the scope of the appended claims.

What is claimed is:

1. A method of synthesizing speech with a system having a programmed central processing unit, comprising the steps of:

generating phonetic parameters from a series of phonetic symbols of an input text;

generating prosodic parameters from prosodic information of the input text;

detecting an activity rate of the central processing unit;

determining a degree number of at least one particular phonetic parameter, each particular phonetic parameter having a different degree number in different contexts, depending on the detected activity rate of the central processing unit; and generating and filtering synthesized speech sounds based on the phonetic and prosodic parameters including adapting the filtering according to the determined degree number of the particular phonetic parameter.

2. A method according to claim 1, wherein said input text has frames, accent phrases., pauses, sentences, and paragraphs, said activity rate of the central processing unit being detected in every frame, every accent phrase, every pause, every sentence, or every paragraph of the input text, or once at the beginning of the input text.

3. A method of synthesizing speech with a system having a programmed central processing unit, comprising the steps of:

generating phonetic parameters from a series of phonetic symbols of an input text;

generating prosodic parameters from prosodic information of the input text;

detecting an activity rate of the central processing unit;

determining a degree number of at least one particular phonetic parameter each particular phonetic parameter having a different degree number in different contexts, said degree number depending on said detected activity rate;

determining a synthesis unit from a plurality of synthesis units according to said particular phonetic parameter; and generating and filtering synthesized speech sounds based on the phonetic and prosodic parameters according to the determined synthesis unit.

4. A method according to claim 3, wherein said input text has frames, accent phrases, pauses, sentences, and paragraphs, said activity rate of the central processing unit being detected in every frame, every accent phrase, every pause, every sentence, or every paragraph of the input text, or once at the beginning of the input text.

5. A method of synthesizing speech with a system having a programmed central processing unit, comprising the steps of:

generating phonetic parameters from a series of phonetic symbols of an input;

generating prosodic parameters from prosodic information of the input text;

detecting an activity rate of the central processing unit;

inputting information representative of a quality of synthesized speech sounds to be generated depending on the activity rate of the central processing unit;

determining a degree number of at least one particular phonetic parameter, each particular phonetic parameter having a different degree number in different contexts, said degree number being determined according to the input information; and selecting a synthesis unit from among a plurality of synthesis units according to said degree number of said particular phonetic parameter during each one of a plurality of different periods of time; and generating and filtering synthesized speech sounds based on the phonetic and prosodic parameters employing said selected synthesis unit.

6. A method according to claim 5, wherein said input text has frames, accent phrases, pauses, sentences, and paragraphs, said activity rate of the central processing unit being detected in every frame, every accent phrase, every pause, every sentence, or every paragraph of the input text, or once at the beginning of the input text.

7. An apparatus for synthesizing speech with a system having a programmed central processing unit, comprising:

means for generating phonetic parameters from a series of phonetic symbols of an input text;

means for generating prosodic parameters from prosodic information of the input text;

detector means for detecting an activity rate of the central processing unit;

control means for determining a degree number of at least one particular phonetic parameter, each particular phonetic parameter having a different degree number in different contexts, said degree number being determined depending on the detected activity rate of the central processing unit; and speech synthesizer means for generating and filtering synthesized speech sounds based on the phonetic and prosodic parameters including adaptable filtering means and means for adapting the adaptable filtering means according to the determined degree number of the particular phonetic parameter.

8. An apparatus according to claim 7, wherein said input text has frames, accent phrases, pauses, sentences, and paragraphs, said detector means comprising means for detecting the activity rate of the central processing unit in every frame, every accent phrase, every pause, every sentence, or every paragraph of the input text, or once at the beginning of the input text.

9. An apparatus for synthesizing speech with a system having a programmed central processing unit, comprising:

means for generating phonetic parameters from a series of phonetic symbols of an input text;

means for generating prosodic parameters from prosodic information of the input text;

a plurality of synthesis units for effecting filtering during synthesis of speech sounds;

detector means for detecting an activity rate of the central processing unit;

means for determining a degree number of at least one particular phonetic parameter, each particular phonetic parameter having a different degree number in different contexts, said particular degree number depending on said detected activity rate;

selector means for selecting a respective one of said plurality of synthesis units according to said degree number of said particular phonetic parameter during each one of a plurality of different periods of time, a plurality of phonetic parameters and a plurality of prosodic parameters being generated during each one of said plurality of different periods of time; and means including the selected synthesis unit for applying all said phonetic and prosodic parameters generated during each said one period of time to the respective one synthesis unit which is selected by said selector means to generate synthesized speech sounds.

10. An apparatus according to claim 9, wherein said input text has frames, accent phrases, pauses, sentences, and paragraphs, said detector means comprising means for detecting the activity rate of the central processing unit in every frame, every accent phrase, every pause, every sentence, or every paragraph of the input text, or once at the beginning of the input text.

11. An apparatus for synthesizing speech with a system having a programmed central processing unit, comprising:

means for generating phonetic parameters from a series of phonetic symbols of an input text;

means for generating prosodic parameters from prosodic information of the input text;

a plurality of synthesis units for effecting filtering during synthesis of speech sounds;

detector means for detecting an activity rate of the central processing unit;

means for determining a degree number of at least one particular phonetic parameter, each particular phonetic parameter having a different degree number in different contexts, said degree number depending on one of said detected activity rate and a quality of synthesized speech sounds to be generated;

selector means for selecting a respective one of said plurality of synthesis units according to said degree number of said particular phonetic parameter during each one of a plurality of different periods of time, a plurality of phonetic parameters and a plurality of prosodic parameters being generated during each one of said plurality of different periods of time; and means including the selected synthesis unit for applying all of said phonetic and prosodic parameters generated during each said one period of time to the respective one synthesis unit that is selected by said selector means to generate synthesized speech sounds.

12. An apparatus according to claim 11, wherein said input text has frames, accent phrases, pauses, sentences, and paragraphs, said detector means comprising means for detecting the activity rate of the central processing unit in every frame, every accent phrase, every pause, every sentence, or every paragraph of the input text, or once at the beginning of the input text.

13. An apparatus for synthesizing speech with a system having a programmed central processing unit, comprising:

means for generating phonetic parameters from a series of phonetic symbols of an input text;

means for generating prosodic parameters from prosodic information of the input text;

input means for inputting information representative of a degree number of phonetic parameters in a first mode;

detector means for detecting an activity rate of the central processing unit in a second mode;

mode selector means for selecting one of said first and second modes;

control means for determining information representative of a degree number of at least one particular phonetic parameter, each particular phonetic parameter having a different degree number in different contexts, depending on the detected activity rate of the central processing unit; and speech synthesizer means for generating and filtering synthesized speech sounds based on the phonetic and prosodic parameters according to the information input by said input means in said first mode selected by said mode selector means and according to the information determined by said control means in said second mode selected by said mode selection means.

14. An apparatus for synthesizing speech with a system having a programmed central processing unit, comprising:

means for generating phonetic parameters from a series of phonetic symbols of an input text;

means for generating prosodic parameters from prosodic information of the input text;

input means for inputting information representative of a quality of synthesized speech sounds to be generated in a first mode;

detector means for detecting an activity rate of the central processing unit in a second mode;

mode selector means for selecting one of said first and second modes;

control means for determining information representative of depending on the detected activity rate of the central processing unit; and control means for determining information representative of a degree number of at least one particular phonetic parameter, each particular phonetic parameter having a different degree number in different contexts, depending on the detected activity rate of the central processing unit; and speech synthesizer means for generating and filtering synthesized speech sounds based on the phonetic and prosodic parameters according to the information input by said input means in said first mode selected by said mode selector means and according to the information including said degree number determined by said control means in said second mode selected by said mode selector means.

15. An apparatus for synthesizing speech with a system having a programmed central processing unit, comprising:

means for generating phonetic parameters from a series of phonetic symbols of an input text;

means for generating prosodic parameters from prosodic information of the input text;

a plurality of synthesis units for effecting filtering on synthesized speech sounds for respective different periods of time;

input means for inputting information representative of one of said synthesis units in a first mode;

detector means for detecting an activity rate of the central processing unit in a second mode;

mode selector means for selecting one of said first and second modes;

means for generating a degree number of at least one particular phonetic parameter, each particular phonetic parameter having a different degree number in differing contexts, the degree number of said particular phonetic parameter depending on the detected activity rate of the central processing unit;

synthesis unit selector means for selecting said one of the synthesis units which is represented by the information input by said input means in said first mode selected by said mode selector means and for selecting one of the synthesis units depending on the the degree number of said particular phonetic parameter in said second mode selected by said mode selector means; and speech synthesizer means for generating and filtering synthesized speech sounds based on the phonetic and prosodic parameters with said selected synthesis unit.

* * * * *